United States Patent [19]

Stecker

[11] Patent Number: 4,867,135

[45] Date of Patent: Sep. 19, 1989

[54] FIREPLACE PROTECTION PAD

[76] Inventor: Aldin Stecker, 885 Briarstone Dr., Mason City, Iowa 50401

[21] Appl. No.: 234,089

[22] Filed: Aug. 19, 1988

[51] Int. Cl.[4] ..... F24B 13/02

[52] U.S. Cl. ..... 126/500; 248/345.1; 108/27

[58] Field of Search ..... 126/500, 544, 546, 12, 126/221, 201; 220/80 R; 428/920, 921, 904.4; 150/55, 52 R, 52 F; 160/237, 382; 108/27; 248/345.1

[56] References Cited

U.S. PATENT DOCUMENTS

| | | | |
|---|---|---|---|
| 315,345 | 4/1885 | Sanders | 126/544 |
| 344,294 | 6/1886 | Walling | 126/544 |
| 474,191 | 5/1892 | Scanlan | 126/546 |
| 494,046 | 3/1893 | Vance | 126/546 |
| 727,251 | 5/1903 | Allen | 126/221 |
| 2,293,751 | 8/1942 | May | 52/197 |
| 2,474,102 | 6/1949 | Gershon | 126/221 X |
| 2,518,107 | 8/1950 | Wilson | 248/345.1 |
| 2,606,755 | 8/1952 | Samuels | 248/345.1 |
| 2,867,015 | 1/1959 | Meissner | 52/179 |
| 3,712,003 | 1/1973 | Hallock et al. | 52/254 |
| 4,117,782 | 10/1978 | Cahill | 108/27 |
| 4,153,230 | 5/1979 | Giacin | 248/345.1 |
| 4,416,251 | 11/1983 | Rachels, Sr. | 126/201 |

*Primary Examiner*—Larry Jones
*Attorney, Agent, or Firm*—Kent A. Herink

[57] ABSTRACT

A pad for covering exposed surfaces of a fireplace hearth to protect against injuries due to forceful contact with the hearth. The pad includes a top piece, a front piece, and a left and a right side piece which are releasably attachable at their mating edge portions to form a four-sided open box shaped protective pad.

7 Claims, 3 Drawing Sheets

FIREPLACE PROTECTION PAD

BACKGROUND OF THE INVENTION

The invention relates to protective padding products and, more specifically, to a four-sided protection pad for a fireplace hearth.

Fireplaces are familiar structures in modern homes Popular construction techniques erect a rectangular-shaped hearth which extends from the floor to the lower edge of the firebox of the fireplace. The hearth also projects from the front edge of the fireplace out into the room in which the fireplace is located. The resultant hearth is generally between 10 and 18 inches high and projects forwardly of the fireplace generally between 10 and 24 inches.

Such hearths are usually constructed of masonry or have an outer exterior surface of masonry. Due to the stone or masonry outer contact surface and the projection of the hearth into a room, the unprotected hearth presents a danger of personal injury to those who may come into forceful contact with the hearth. This danger is particularly severe in the instance of infants and toddlers whose lack of coordination and frequency of falling increase the likelihood of their forceful contact with a hearth.

The present invention provides an inexpensive, adaptable, easy to assemble, and effective means for covering a fireplace hearth with a padded material so as to limit or prevent personal injury that might otherwise occur from forceful bodily contact with a unprotected hearth.

SUMMARY OF THE INVENTION

The invention consists of a four-sided pad for covering the exposed surfaces of a fireplace hearth. The pad is comprised of four individual pieces of protective padding that are removably joined at adjacent edge portions thereof. The pieces include a top piece, a front piece, and a pair of opposite side pieces. Snaps, Velcro ®, zippers, or other like fastening means are used to join adjacent edges of the pieces to form the four-sided box which is then placed over the hearth. In an alternative embodiment, a four-sided box shaped pad is formed of three pieces, a single top and front piece and two opposite side pieces. In a similar manner to the first embodiment, the four-sided box is formed by the joining of the adjacent edge portions of the two side pieces and the single top and front piece.

DETAILED DESCRIPTION OF A PREFERRED EMBODIMENT

Figure 1:
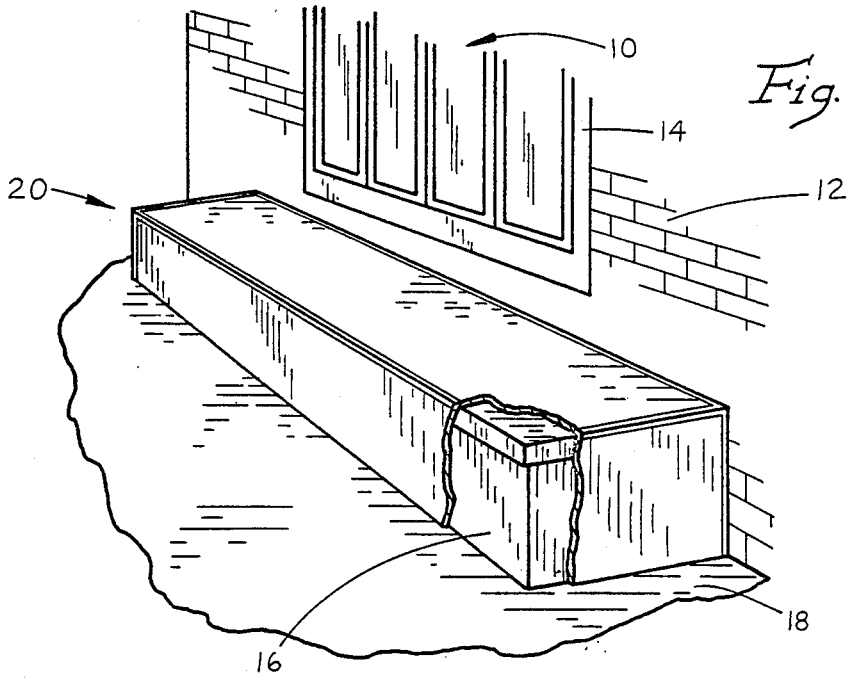
FIG. 1 is a perspective view of the fireplace hearth protection pad shown assembled and in place over a fireplace hearth with a section removed to show the hearth.

Illustrated in FIG. 1, generally at 10, is a fireplace constructed in a wall 12 and having fireplace doors 14. A fireplace hearth 16 extends outwardly from the wall 12 generally beneath the fireplace 10 and raised above a floor 18 of the room in which the fireplace is located. The hearth 16 is of a generally rectangular box-shape having a top portion, a front portion, and two opposite side portions. A fireplace hearth protection pad, indicated generally at 20 in FIG. 1, has been assembled and placed into use over the fireplace hearth 16.

Figure 2:
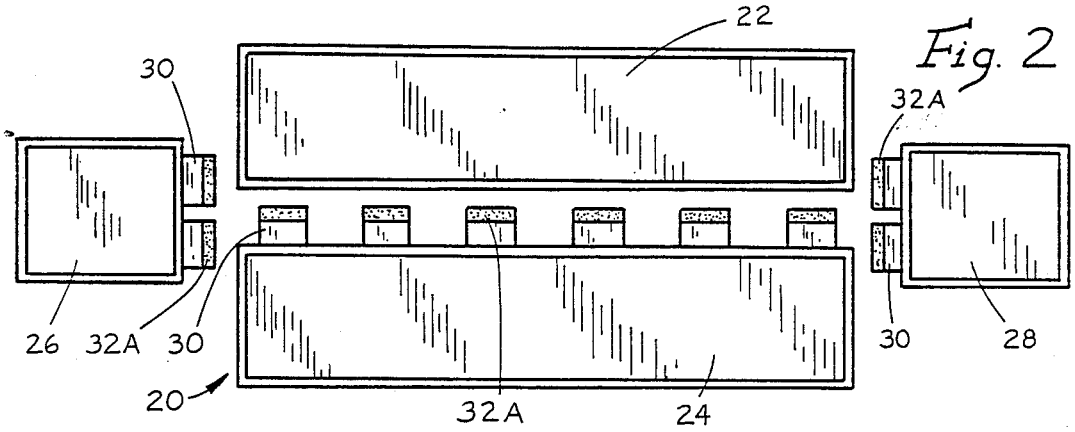
FIG. 2 is a plan view of the four pieces of the protection pad and showing a plurality of attachment tabs.
Figure 3:
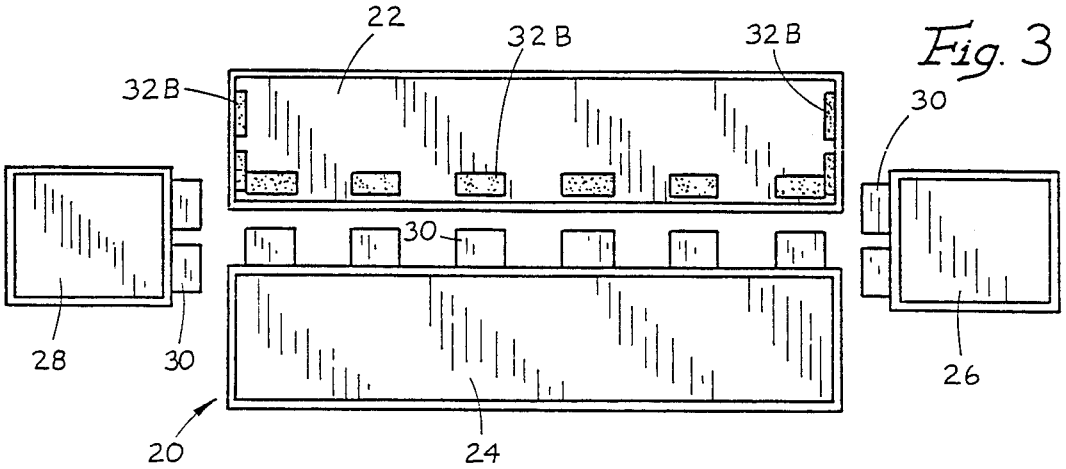
FIG. 3 is a bottom view of the four pieces of the protection pad showing the plurality of attachment tabs and a plurality of attachment surfaces corresponding to such attachment tabs.

As illustrated in FIGS. 2 and 3, the fireplace hearth protection pad 20 is comprised of four pieces; top piece 22, front piece 24, left side piece 26, and right side piece 28. Each piece 22–28 is a rectangular piece of resilient, cushioning material of approximately the dimensions of the corresponding portion of the fireplace hearth 16 (FIG. 1). In the preferred embodiment, a rectangular piece of open-cell foam of approximately one inch in thickness is covered by a durable and attractive covering material such as leather or upholstery vinyl.

In FIG. 2, the surfaces of the pieces 22–28 that will be on the outside of the assembled fireplace protection pad 20 are shown. The upper edge portion of the front piece 24 and the two side pieces 26 and 28 include a plurality of extended attachment tabs 30 which are used to attach the pieces 22–28 to each other to assemble the fireplace protection pad 20. The terminal portion of each tab 30 includes an outwardly facing layer of Velcro ® **32*a*. On the underside of the top piece 22 (FIG. 3), a mating piece of Velcro ® 32*b* to the Velcro ® pieces 32*a* is attached in a position corresponding to the Velcro ® pieces 32*a* of the plurality of tabs 30. To assemble the fireplace protection pad 20, the layer of Velcro ® 32*a* on each tab 30 is positioned over and pressed into the corresponding piece of mating Velcro ® 32*b* on the underside of the top piece 22. In this way, the top edge of right side piece 28 is positioned adjacent the right side edge of top piece 22, the top edge portion of left side piece 26 is positioned adjacent to the left side edge of the top piece 22, and the top edge portion of the front piece 24 is positioned adjacent to the front edge portion of the top piece 22. When the assembled protection pad 20 is positioned on the fireplace hearth 16, the top piece 22 is centered on the top of the hearth 16 and the front piece 24 and the side pieces 26 and 28 hang therefrom substantially vertically to cover the exposed sections of the fireplace hearth 16, as illustrated in FIG. 1. When assembled and placed on the hearth 16, the right side portion of the front piece 24 is adjacent to the front edge portion of the right side piece 28 and the left edge portion of the front piece 24 is adjacent to the front edge portion of the left side piece 26**.

Figure 4:
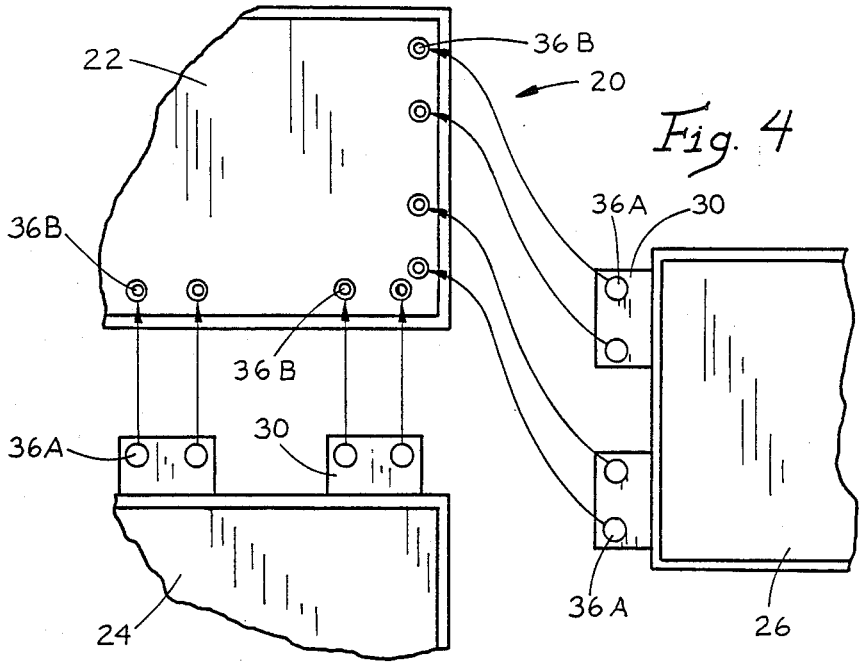
FIG. 4 is a partial view of the edge portions of pieces of the protection pad showing the use of a plurality of snaps as attachment means.

In an alternative embodiment, illustrated in FIG. 4, a plurality of snaps **36*a* and 36*b* are used as attachment devices. The male portion of the snap 36*a* is attached to the terminal end portions of the tabs 30 and the female portion of the snaps 36*b* are attached to the underside of the top piece 22 in positions corresponding to the locations of the male portions 36*a*. The fireplace hearth protection pad 20 is assembled in a similar fashion to the first preferred embodiment, whereby the male portions of the snaps 36***a* are connected to the corresponding female portions of the snaps 36*b*.

Figure 5:
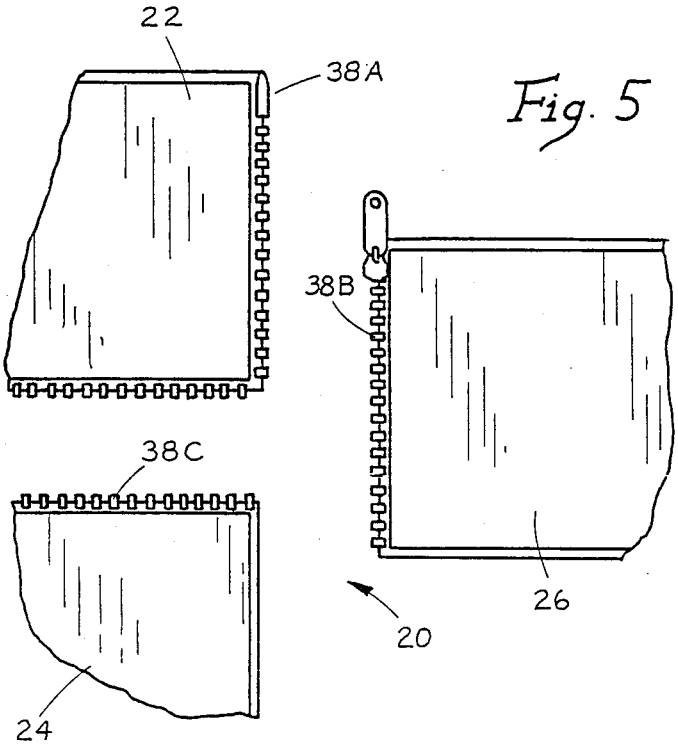
FIG. 5 is a partial view of edge portions of pieces of the protection pad and showing use of zippers as means of attachment.

A third preferred embodiment is illustrated in FIG. 5 wherein a zipper, including portions 38*a*, 38*b*, and 38*c* are attached to certain edge portions of the fireplace protection pad pieces 22–28. Zipper portion 38*a* is attached to the left side edge portion, the front edge portion and the right side edge portion of the top piece 22; zipper portion 38*b* is attached to the front edge portion of the left side piece 26; zipper portion 38*c* is attached to the top edge portion of the front piece 24; and a zipper portion corresponding to 38*b* (but not shown) is attached to the top edge portion of the right side piece 28. The pieces 22–28 are assembled to form the fireplace hearth protection pad 20 by positioning the top edge portions of the pieces 24–28 adjacent to the corresponding edges of the piece 22 and closing of the zipper 38.

Figure 6:
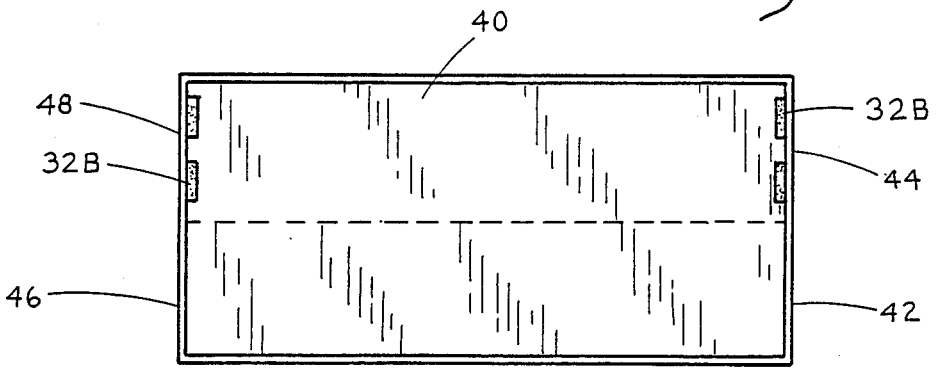
FIG. 6 is a plan view of a second embodiment of the protection pad wherein the top and front pieces are a single piece.

Either of the three preceding embodiments may also be constructed by use of a one-piece combined top and front piece 40 in place of the top piece 22 and the front piece 24, as illustrated in FIG. 6. The top and front piece 40 will include a vertical left edge portion 42, a horizontal left edge portion 44, a vertical right edge portion 46, and a horizontal right edge portion 48, corresponding to the general orientation of the respective edge portion when the assembled protection pad is placed in use over a hearth. Any of the attachment means discussed above can be employed in removably attaching a right and a left side piece to the horizontal left and right edge portions 44 and 48 of the top and front piece 40. Velcro® pieces 32*b* are shown.

Figure 7:
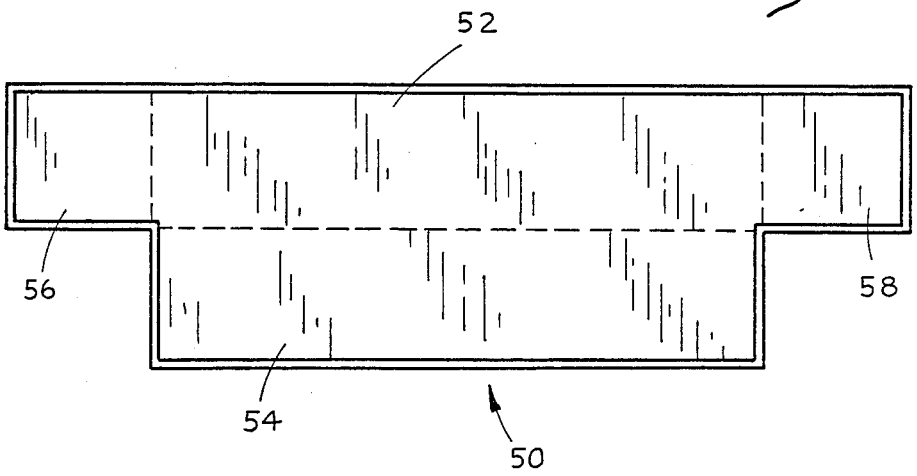
FIG. 7 is a plan view of a single-piece embodiment of the hearth protection pad wherein the top, front, left side, and right side piece are a single piece.

A single-piece embodiment is shown in FIG. 7 wherein a top 52, front 54, left side 56, and right side 58 pieces are combined into a single piece 50. Upon proper orientation of the single piece 50 over a hearth, the front piece 54 will fold downwardly to cove the front of the hearth and the left and right side pieces 56 and 58 will fold downwardly to cover the left and right side portions of the hearth.

While the invention has been described with respect to preferred embodiments thereof, it is to be understood that numerous changes may be made, such as changes in fastening or attachment means, or use of attachment means also to removably attach the front edge portions of the right and left side portions to the front piece, without departing from the spirit or scope of the invention and defined in the following claims.

I claim:

1. A pad for covering a fireplace hearth, comprising:

(a) a top piece having a rear edge portion, a front edge portion, a left edge portion, and a right edge portion;

(b) a front piece having a bottom edge portion, a top edge portion, a left edge portion, and a right edge portion;

(c) a left side piece and a right side piece, each of which has a bottom edge portion, a rear edge portion, a front edge portion, and a top edge portion; and (d) means for releasably joining (i) said front edge portion of said top piece to said top edge portion of said front piece, (ii) said left side edge portion of said top piece to said top edge portion of said left side piece, and (iii) said right side edge portion of said top piece to said top edge portion of said right side piece.

2. A pad for covering a fireplace hearth, comprising:

(a) a top and front piece having a rear edge portion, a bottom edge portion, a vertical and a horizontal left edge portion, and a vertical and a horizontal right edge portion;

(b) a left side piece and a right side piece, each of which has a bottom edge portion, a rear edge portion, a front edge portion, and a top edge portion; and (c) means for releasably joining (i) said horizontal left side edge portion of said top and front piece to said top edge portion of said left side piece, and (ii) said horizontal right side edge portion of said top and front piece to said top edge portion of said right side piece.

3. The pad as defied in claim 1, wherein:

(a) said releasable joining means include a plurality of extended tabs along the top edge portions of the front piece, the right side piece, and the left side piece;

(b) fastening means on said extended tabs; and (c) second fastening means on said top piece corresponding in number and location to the first fastening means on said plurality of tabs whereby said first fastening means and said second fastening means can be releasably fastened.

4. The pad as defined in claim 3, wherein said first and second fastening means are hook and loop releasable

5. The pad as defined in claim 3 wherein said fastening means are snaps.

6. The pad as defined in claim 1, wherein:

(a) said releasable joining means is a zipper wherein one portion of said zipper extends along the left edge portion, front edge portion, and right edge portion of the top piece and a mating portion of said zipper extends along the top edge portion of the left side piece, the top edge portion of the front piece, and the top edge portion of the right side piece.

7. A pad as defined in claim 2, wherein:

(a) said releasable joining means include a plurality of tabs extended from the top edge portions of the left side piece and the right side piece;

(b) first fastening means on said plurality of tabs; and (c) second fastening means on said top and front piece adjacent the horizontal left edge portion and the horizontal right edge portion corresponding in number and location to the first fastening means on said plurality of tabs.

* * * * *